US006948978B2

(12) United States Patent
Itou et al.

(10) Patent No.: US 6,948,978 B2
(45) Date of Patent: Sep. 27, 2005

(54) CONNECTOR AND A METHOD OF ASSEMBLING SUCH CONNECTOR

(75) Inventors: Tomonari Itou, Yokkaichi (JP); Keigo Atsumi, Yokkaichi (JP); Atsushi Nishida, Toyota (JP); Masato Minakata, Toyota (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/824,116

(22) Filed: Apr. 13, 2004

(65) Prior Publication Data

US 2004/0203287 A1 Oct. 14, 2004

(30) Foreign Application Priority Data

Apr. 14, 2003 (JP) ..... 2003-108770

(51) Int. Cl.[7] ..... H01R 13/40
(52) U.S. Cl. ..... 439/595
(58) Field of Search ..... 439/595, 752, 439/752.5

(56) References Cited

U.S. PATENT DOCUMENTS 5,839,921 A * 11/1998 Yamanashi ..... 439/595
6,244,900 B1 * 6/2001 Ishikawa et al. ..... 439/595
6,478,620 B1 * 11/2002 Bonavita et al. ..... 439/595
6,520,801 B2 * 2/2003 Tabata et al. ..... 439/595
6,655,993 B1 * 12/2003 Yamamoto ..... 439/595
6,682,366 B2 * 1/2004 Tanaka ..... 439/595
6,796,836 B2 * 9/2004 Ichida et al. ..... 439/595

FOREIGN PATENT DOCUMENTS

JP 3-55674 3/1991

* cited by examiner

*Primary Examiner*—Renee Luebke
*Assistant Examiner*—James R. Harvey
(74) *Attorney, Agent, or Firm*—Gerald E. Hespos; Anthony J. Casella

(57) ABSTRACT

A connector has a housing (20) with cavities (26) for receiving terminals (10). A lock (30) projects is provided in each cavity (26) and has a forwardly tapered locking surface (32) that is sloped to project more forward at the base than at the top. The connector also has a retainer (50) with a restricting plate (53) to prevent displacement of the locks (30) toward deformation spaces (36). Push-up protrusions (60) of the restricting plate (53) slip under the lower surfaces of the locks (30) as the retainer (50) is pushed towards a full locking position and push the locks (30) up towards cavities (26). A cam action of the sloped locking surfaces (32) pushes the female terminals (10) forward and against front walls (27).

8 Claims, 13 Drawing Sheets

CONNECTOR AND A METHOD OF ASSEMBLING SUCH CONNECTOR

BACKGROUND OF THE INVENTION

1. Field of the Invention

The invention relates to a connector configured to prevent abrasion of a terminal fitting and to a method of assembling such a connector.

2. Description of the Related Art

Japanese Unexamined Utility Model Publication No. H03-55674 and FIG. 13 herein show a connector. With reference to FIG. 13, the connector has a housing 1 formed with a cavity 2. A terminal fitting 3 is inserted into the cavity 2 and resiliently displaces a lock 4 in the cavity 2. The lock 4 then returns when the terminal fitting 3 is inserted by a specified distance so that a locking projection 5 on the upper surface of the lock 4 fits into a locking hole 6 in the terminal fitting 3 and engages a front edge of the locking hole 6. Thus, the locking projection 5 locks the terminal fitting 3 so as not to come out.

A clearance C normally is present between the terminal fitting 3 and a front wall 2A of the cavity 2. The clearance C is set beforehand to enable the lock 4 to fit securely into the locking hole 6. Alternatively, the clearance may be formed unintentionally due to a molding error.

The clearance C enables the terminal fitting 3 to make loose forward and backward movements in the cavity 2. Such movements create relative sliding at a contact portion with a mating terminal fitting, and lead to abrasion, if the connector is subjected to vibration, such as the vibration in an engine compartment. A large clearance C enables the terminal fitting 3 to move loosely over a longer distance and a range of abrasion is extended. Accordingly, the reliability of an electrical connection is reduced due to, for example, a reduced contact pressure.

The present invention was developed in view of the above problem and an object thereof is to reduce or prevent abrasion of a terminal fitting caused by sliding movements.

SUMMARY OF THE INVENTION

The invention relates to a connector with a housing that has at least one cavity for receiving a terminal fitting. A resiliently displaceable lock is provided on an inner wall of the cavity and has a locking surface. The terminal fitting displaces the lock as the terminal fitting is inserted into the cavity. However, the lock returns when the terminal fitting is inserted a specified distance into the cavity. As a result, the locking surface of the lock engages the terminal fitting and prevents the terminal fitting from coming out of the cavity. The locking surface of the lock is slanted to form an obtuse angle to the inserting direction. Thus, the locking surface has a forward taper and projects more forward at positions farther from the terminal fitting. Accordingly, the locking surface moves the terminal fitting forward by pushing the engaging portion when the lock returns to engage the terminal fitting. Therefore, a clearance between the terminal fitting and the front wall of the cavity can be kept small.

Any loose forward and backward movements that may be generated by vibration will be made only over a short distance. Thus, abrasion at a contact portion of the terminal fitting with a mating terminal fitting will be suppressed. As a result, a sufficient contact pressure is assured and the electrical connection is reliable.

The connector preferably has a retainer for entering a deformation space for the lock to prevent resilient displacement of the lock. The retainer preferably includes at least one pushing portion for engaging the lock and urging the lock towards the terminal fitting and in a direction substantially opposite to the deformation direction of the lock.

The pushing portion of the retainer pushes the lock towards the terminal fitting and the forward taper of the locking surface generates a cam action that pushes the terminal fitting forward. Thus, the terminal fitting is brought into contact with the front wall of the cavity to eliminate the clearance.

The connector preferably has means for holding the retainer at a partial locking position where the retainer is retracted from the deformation space to permit the resilient displacement of the locking and/or at a full locking position where the retainer is in the deformation space. The housing and the retainer can be handled as a unit during assembly while the retainer is at the partial locking position. This makes various operations easier.

An angle of inclination of the locking surface of the lock is set so that a trace of displacement of an end of the locking surface closer to the terminal fitting is more backward relative to the inserting direction than the engaging portion of the terminal fitting. Thus, the locking surface will not interfere with the engaging portion of the terminal fitting when the lock is displaced towards the deformation space from a position where the lock engages the terminal fitting while the terminal fitting contacts a front wall of the cavity.

The lock can be displaced towards the deformation space without interfering with the engaging portion, and the locked state by the lock can be canceled, for example, in the case of detaching the terminal fitting.

The lock may have a disengagement operable portion for engaging a disengagement jig inserted into housing. The disengagement operable portion preferably is inclined with respect to the inserting direction and has a greater angle of inclination than the angle of inclination of the locking surface.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
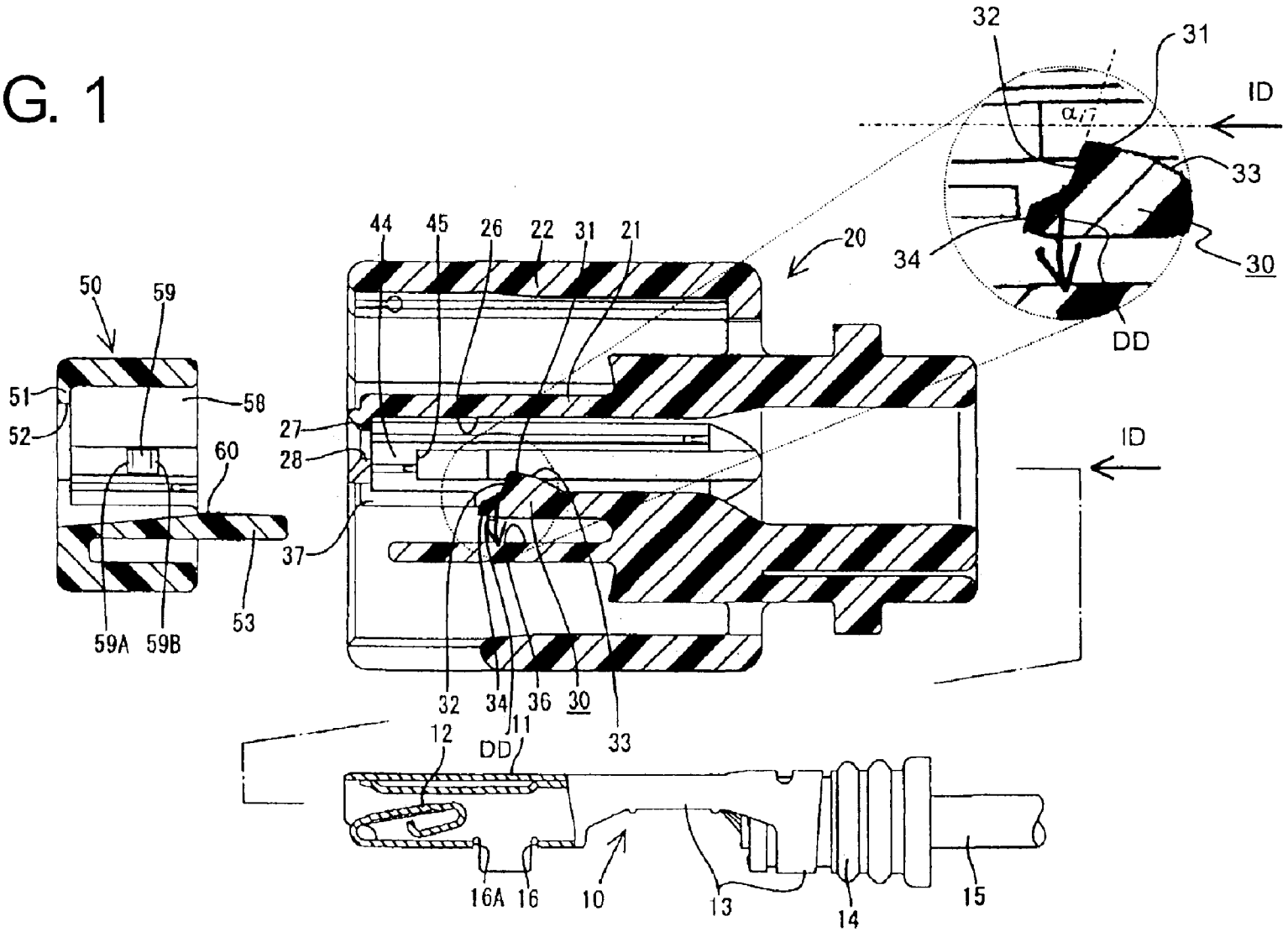
FIG. 1 is an exploded longitudinal section of a female connector according to one embodiment of the invention.

A female watertight connector according to the invention is described with reference to FIGS. 1 to 12. The connector has female terminals 10 and a female housing 20 into which the female terminals 10 are received. The connector also includes a retainer 50 for indirectly doubly locking the female terminals 10 as shown in FIG. 1. In the following description, a mating side with a male connector (left side in FIG. 1) is referred to as front side.

Each female terminal 10 is formed by press-working a conductive metallic plate having an excellent electrical conductivity. A rectangular tubular connecting portion 11 is provided at the front side of the female terminal 10 and is formed internally with a resilient contact piece 12 that can be brought into contact with a tab 66 (see chain line in FIG. 11) of a mating male terminal 65. A barrel 13 is formed at the rear of the terminal 10 and is crimped, bent or folded into connection with both a waterproof resilient rubber plug 14 and an end of a wire 15. A locking hole 16 is formed in the bottom surface of the connecting portion 11.

The female housing 20 is made e.g. of a synthetic resin and has a tower 21 and a forwardly open receptacle 22 that covers the tower 21, as shown in FIGS. 1 to 4. A smaller receptacle (not shown) of a mating male housing is fittable between the tower 21 and the receptacle 22. A bulge 23 is formed at the right side of the receptacle 22 when viewed from the front, and a lock arm 24 for locking the female housing 20 and the mating male housing together is provided in the bulge 23.

Two side-by-side cavities 26 extend forward and back in the tower 21 and the female terminals 10 are insertable into the respective cavities 26 in an inserting direction ID. A terminal insertion opening 28 is formed in a front wall 27 of each cavity 26 for receiving the tab 66 of the mating male terminal 65.

A lock 30 is cantilevered forward from the bottom wall of each cavity 26. The lock 30 is formed unitarily with the housing 20 and a locking projection 31 projects into the cavity 26 from an upper surface at the leading end of the lock 30. The locking projection 31 can fit into the locking hole 16 of the female terminal 10 for partly locking the female terminal 10 in the cavity 26. The leading end of the lock 30 is resiliently deformable in a deformation direction DD that intersects the inserting direction ID. Alternatively, the lock 30 may be supported at both the front and rear ends and may have a locking projection 31 at an intermediate portion thereof.

A locking surface 32 is formed at the front of the locking projection 31 and is engageable with a front edge 16A of the locking hole 16. The locking surface 32 has a forward taper and is slanted to project more forward at the base than at the top. More particularly, the locking surface 32 defines an obtuse angle $\alpha$ of inclination to the inserting direction ID that preferably is in the range of about 100° to about 150°, more preferably of about 105° to about 140°, most preferably of about 110° to about 135°.

A guiding surface 33 is defined at the rear of the locking projection 31. The guiding surface 33 is sloped or curved moderately so that the height of the locking projection 31 is gradually shorter toward the back.

A deformation space 36 is formed on a side of the lock 30 opposite the cavity 26 for permitting the leading end of the lock 30 to be deformed resiliently in the deformation direction DD. A jig insertion opening 37 opens forwardly before the deformation space 36 and before a portion of the cavity 26. A disengagement operable portion 34 is formed on the lock 30 before the locking projection 31 and can be pressed by the leading end of a jig J (see FIG. 12) inserted through the jig insertion opening 37 to displace the lock 30 resiliently in the deformation direction DD toward the deformation space 36 for disengaging the lock 30 from the female terminal 10.

Figure 2:
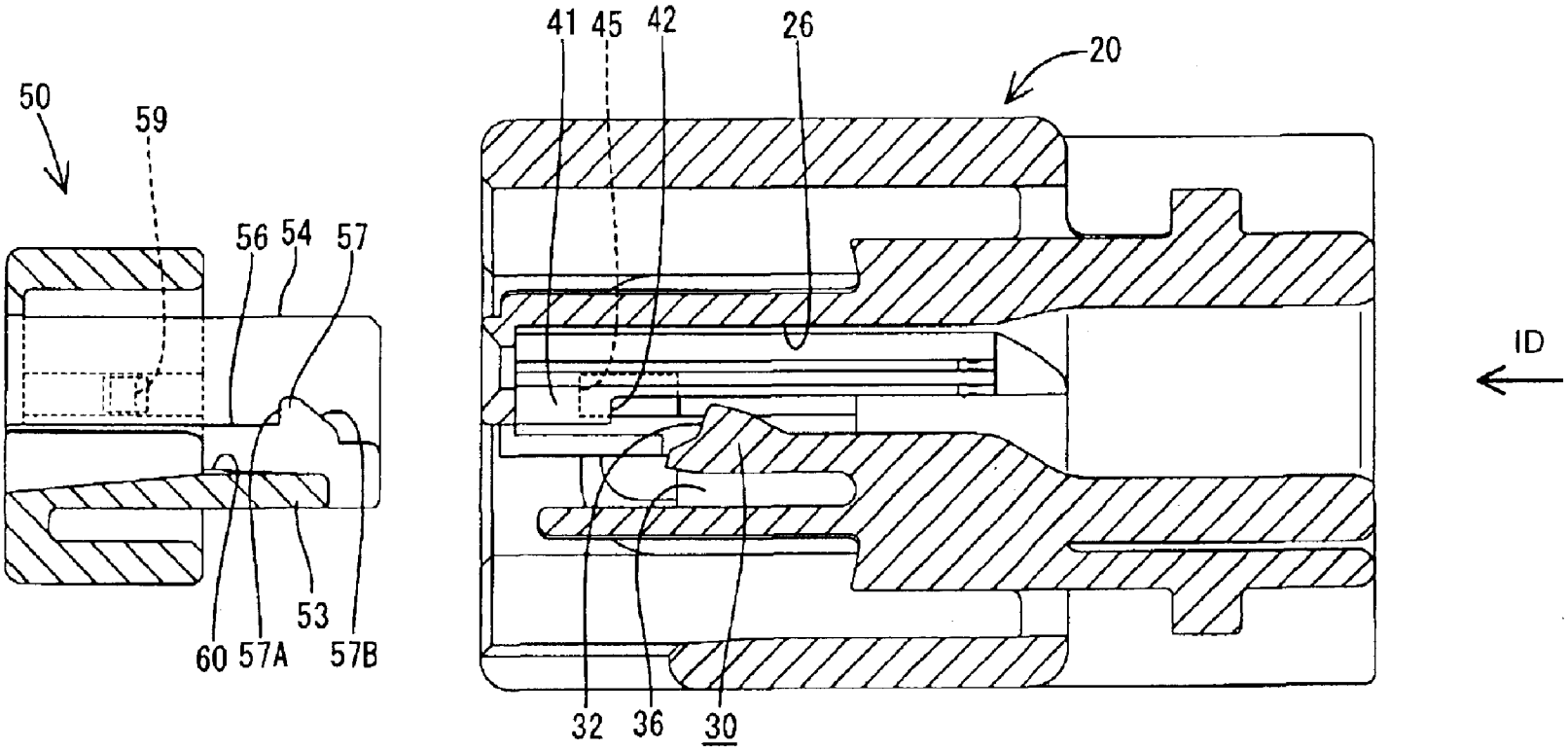
FIG. 2 is a longitudinal section showing a state before a female housing and a retainer are assembled.
Figure 3:
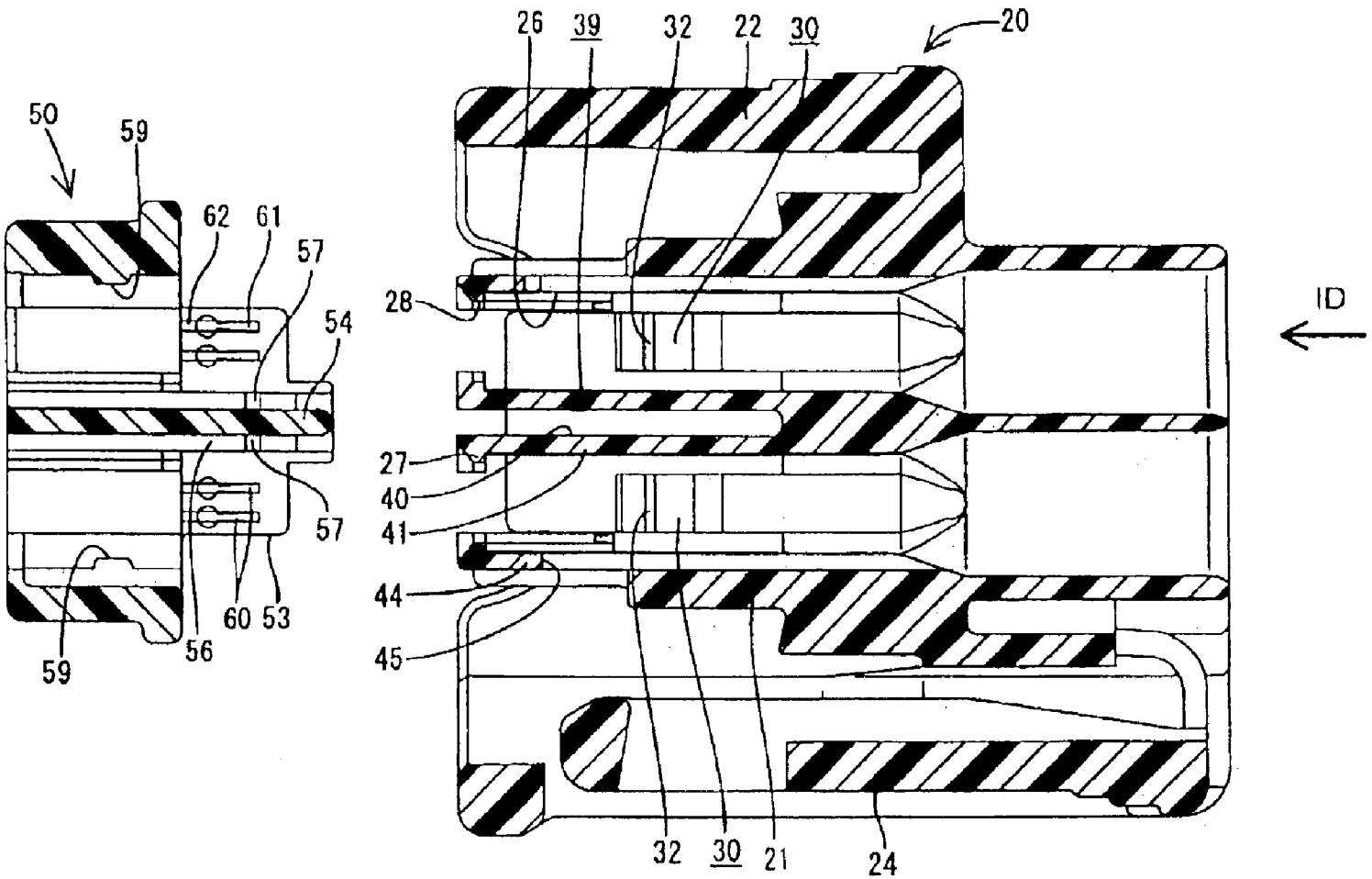
FIG. 3 is a plan view in section showing the state of FIG. 2.
Figure 5:
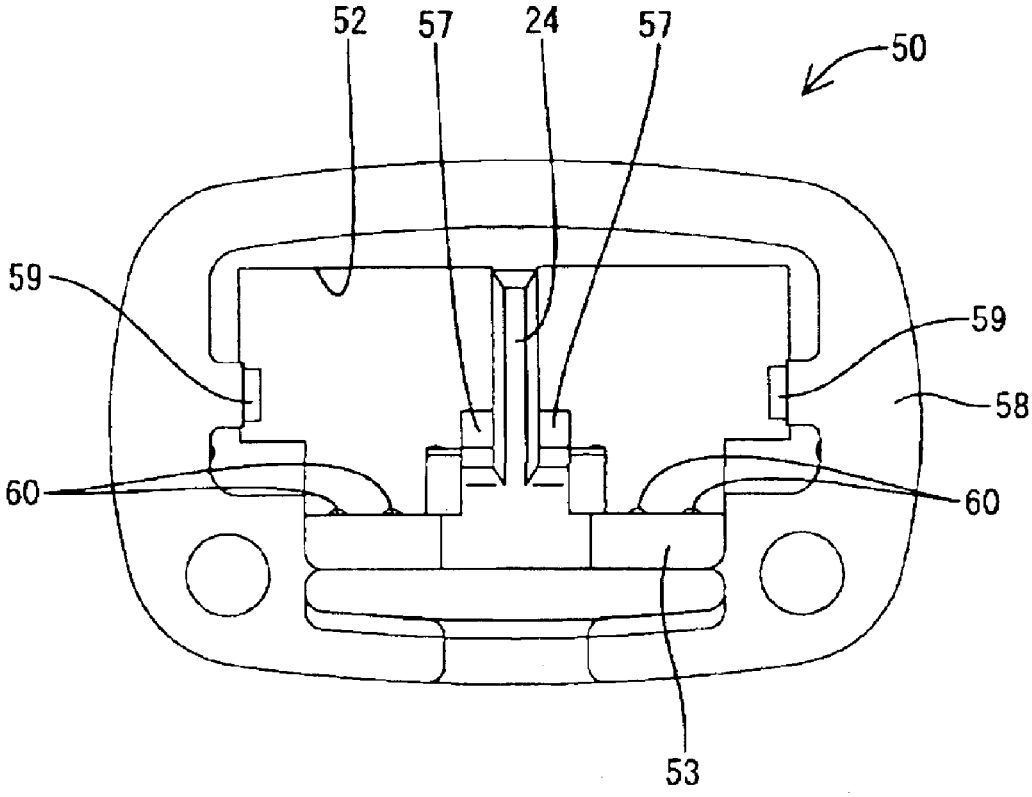
FIG. 5 is a rear view of the retainer.
Figure 6:
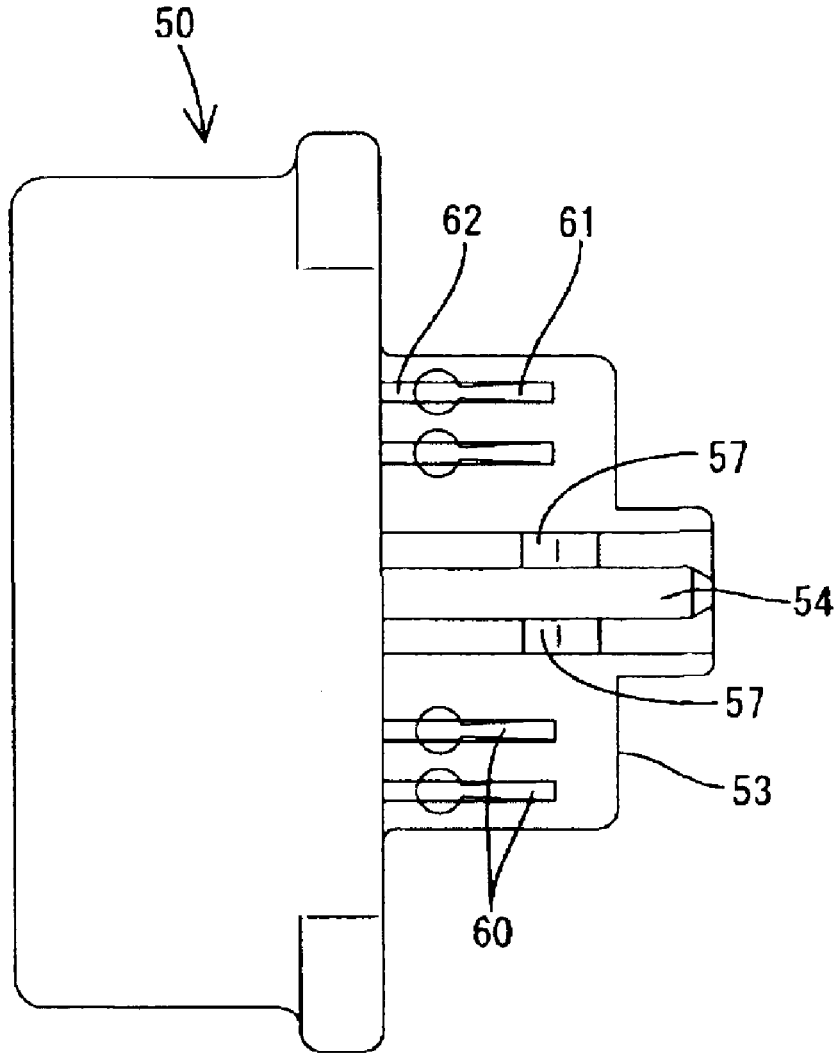
FIG. 6 is a plan view of the retainer.

The retainer 50 is made e.g. of a synthetic resin, and is in the form of a cap mountable on the leading end of the tower 21 of the female housing 20, as shown in FIGS. 1 to 3. Left and right windows 52 are formed in a front wall 51 of the retainer 50, as shown in FIG. 5, and correspond to the cavities 26 of the female housing 20. A restricting plate 53 projects from the bottom edges of the windows 52 to a position more backward than the rear surface of a cap-shaped part of the retainer 50. The restricting plate 53 can enter the deformation spaces 36 of the female housing 20

Figure 4:
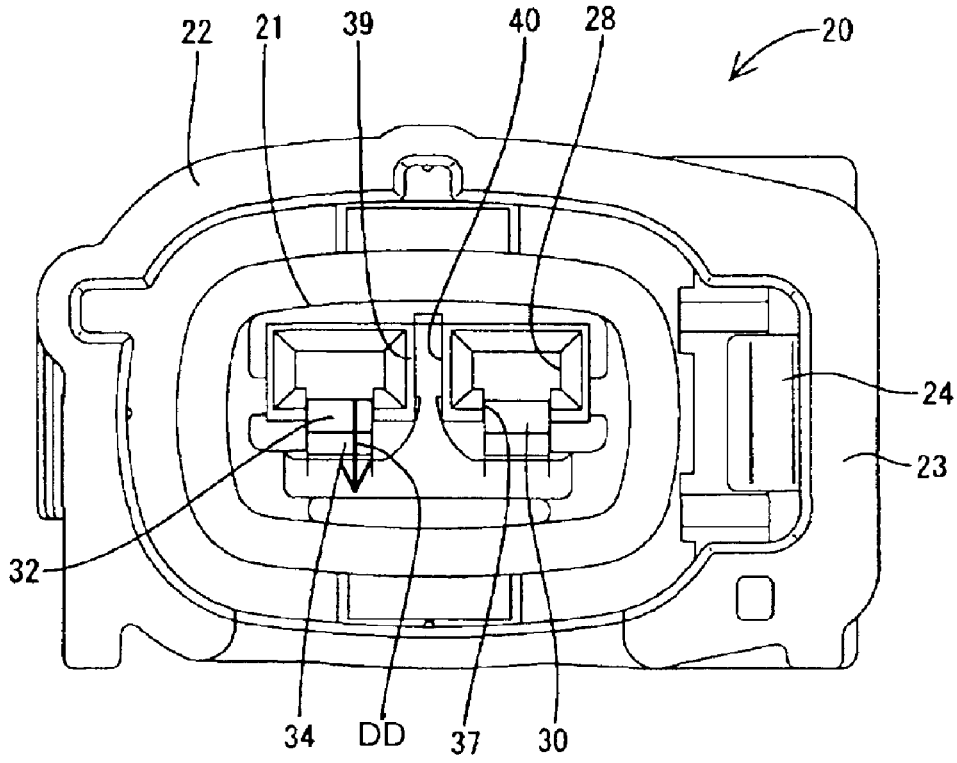
FIG. 4 is a front view of the female housing.

A widthwise middle of the restricting plate 53 projects further back over a specified width area, as shown in FIG. 3, and a guiding wall 54 extends forward and back on the upper surface of this width area to project up substantially normal to the inserting direction ID, as shown in FIGS. 2 and 5. On the other hand, a forwardly open guiding groove 40 is formed in a partition wall 39 between adjacent cavities 26 of the female housing 20, as shown in FIGS. 3 and 4, for receiving the guiding wall 54. Accordingly, the retainer 50 can be mounted on the leading end of the tower 21 by being pushed while aligning the guiding wall 54 with the guiding groove 40.

As shown in FIG. 2, short walls 56 bulge out at the bottoms of the left and right side surfaces of the guiding wall 54 of the retainer 50, and partial locking projections 57 are formed near the rear ends of the short walls 56. A locking surface 57A is defined at the front of each partial locking projection 57 and a slanted guiding surface 57B is at the rear surface thereof. On the other hand, a partial locking portion 42 is formed on each of the side walls 41 at opposite sides of the guiding groove 40 of the female housing 20. The front end of the partial locking portion 42 is lowered over a specified range as shown in FIG. 2, and this lowered portion is engageable with the partial locking projection 57.

Full locking projections 59 are formed on the inner surfaces of left and right walls 58 of the retainer 50 at substantially middle positions with respect to the height direction, as shown in FIGS. 1 and 5. A locking surface 59A and a guiding surface 59B are formed respectively on the front and rear of each full locking projection 59, and are inclined steeply at an obtuse angle to the inner surface of the corresponding left or right wall 58. On the other hand, a side wall 44 of each cavity 26 of the female housing 20 opposite from the partition wall 39 is formed with a full locking hole 45 with which the full locking projection 59 is engageable as shown in FIGS. 1 and 3.

Figure 7:
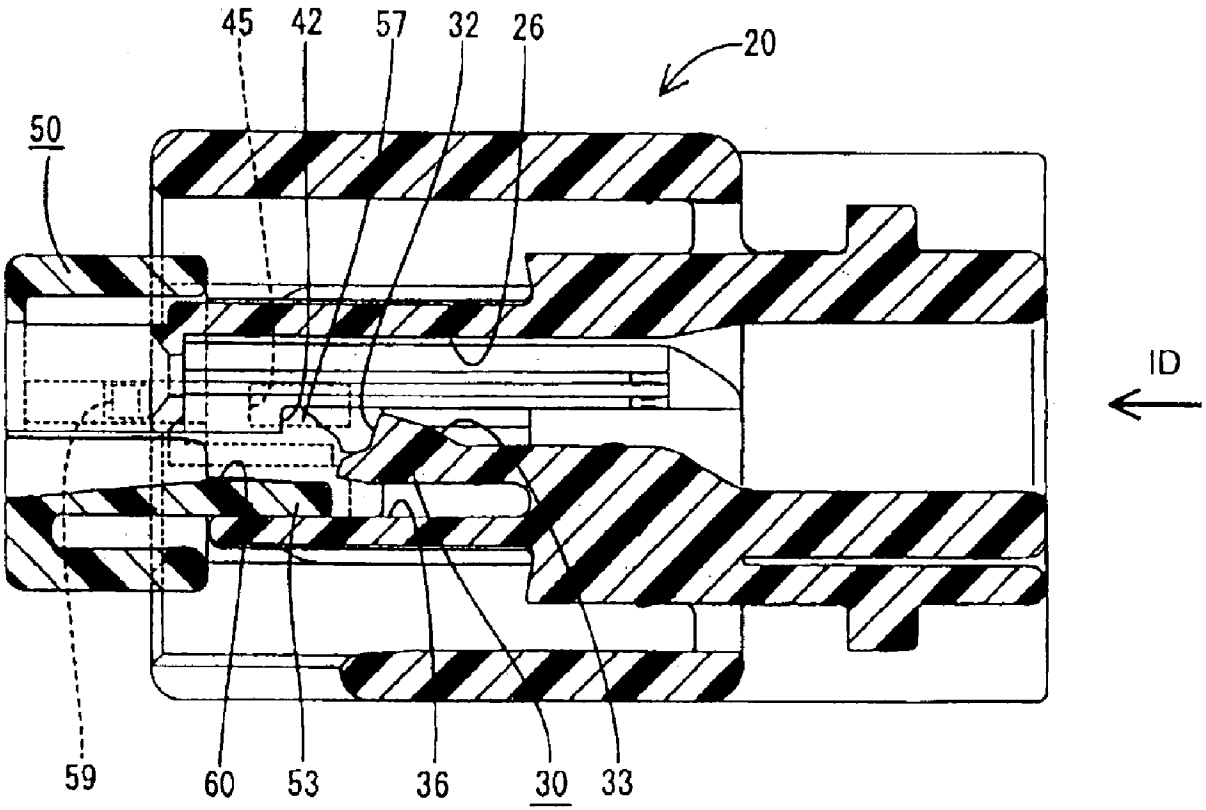
FIG. 7 is a longitudinal section showing a state where the retainer is assembled at a partial locking position.

The retainer 50 is mounted on the leading end of the tower 21 of the female housing 20 and is pushed. Thus, the partial locking projections 57 engage the partial locking portions 42, as shown in FIG. 7, to prevent the retainer 50 from coming off. This position is referred to as a partial locking position of the retainer 50, where the restricting plate 53 is located before the deformation space 36 to permit the displacement of the locks 30.

Figure 10:
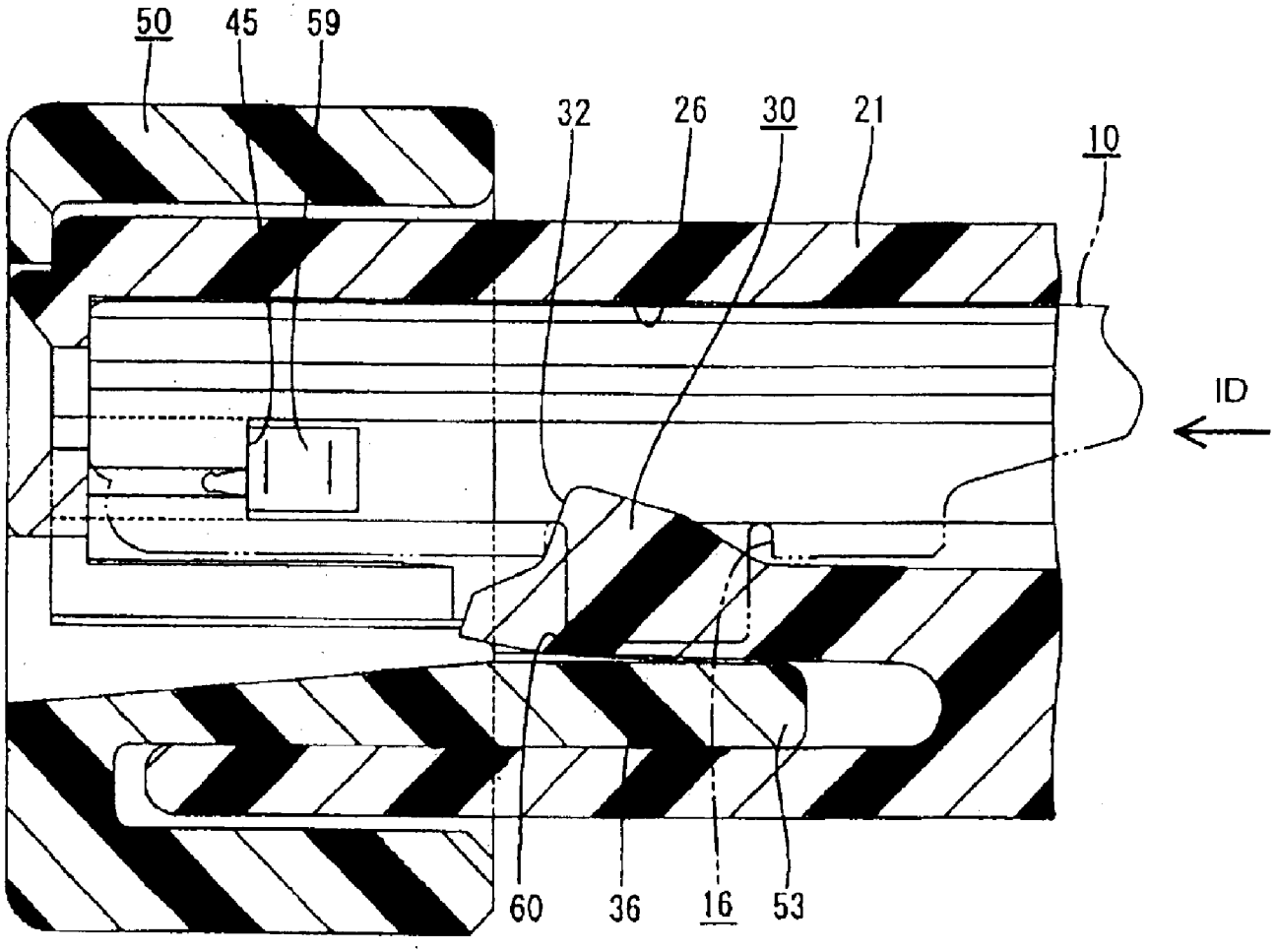
FIG. 10 is a longitudinal section showing a state where the retainer is assembled at a full locking position.

The retainer 50 then is pushed further to the full locking position to abut the front end surface of the tower 21. The full locking projections 59 then fit into the full locking holes 45 as shown in FIG. 10, and the restricting plate 53 is located in the deformation space 36.

The retainer 50 achieves redundant locking by preventing displacement of the locks 30 toward the deformation spaces 36 after the locks 30 have partly locked the female terminals 10. More particularly, the restricting plate 53 of the retainer 50 enters the deformation spaces 36 so that the upper surface of the restricting plate 53 is right below the lower surfaces of the locks 30 that have returned to their natural states.

Figure 9:
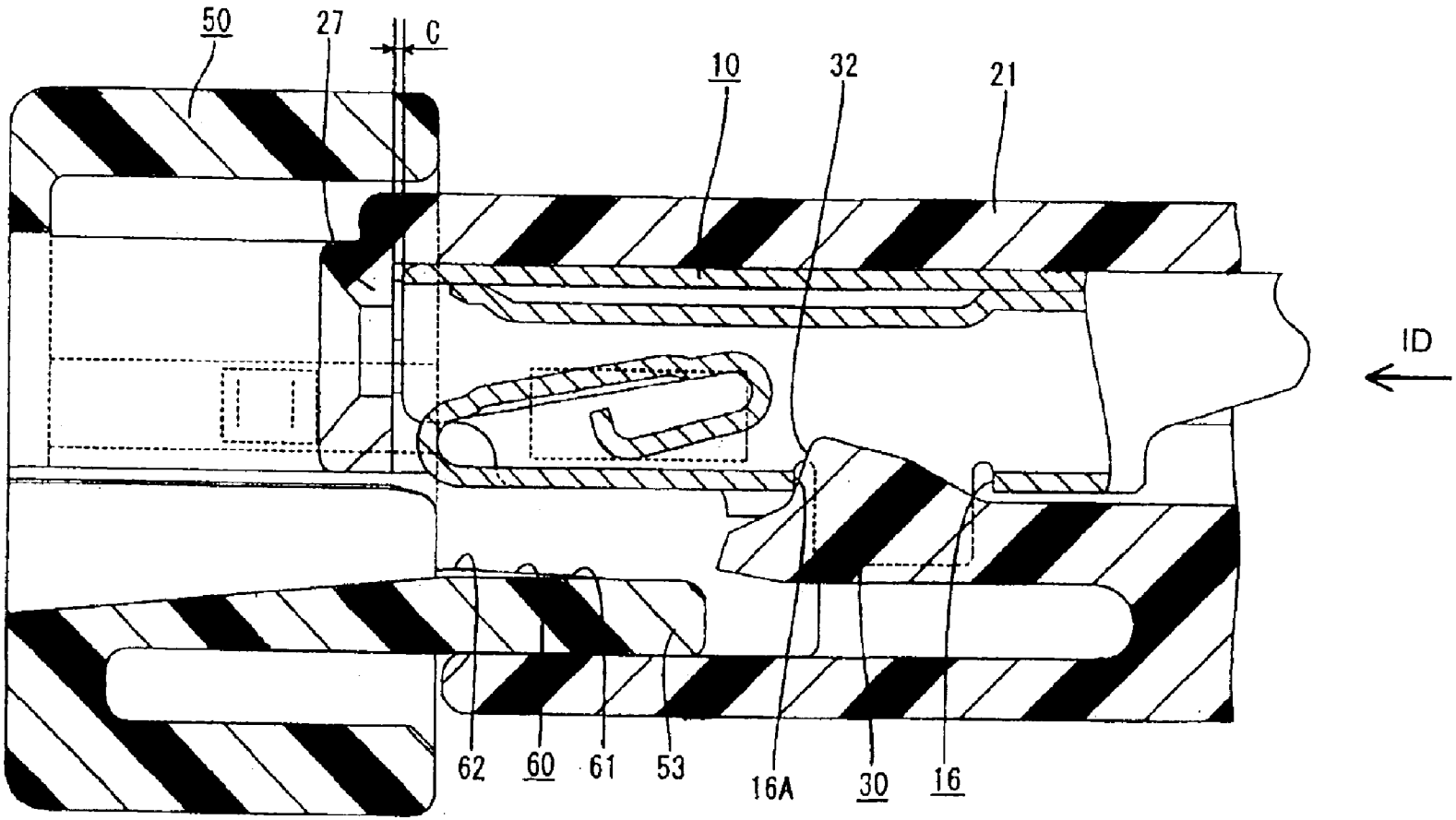
FIG. 9 is a longitudinal section showing a partly locked state of the female terminal.

Two push-up protrusions 60 are formed at positions on the restricting plate 53 corresponding to the lower surface of each lock 30. The push-up protrusions 60 extend from a position forward of the projecting rear edge of the restricting plate 53 to the rear surface of the cap-shaped part of the retainer 50 as shown in FIG. 3. As shown in FIG. 9, each push-up protrusion 60 has a slanted surface 61 moderately sloped up to the front in an area of more than half, preferably of about ¾ of the entire length from the rear edge of the push-up protrusion 60. A remaining area at the front side is a flat surface 62 substantially parallel with the upper surface of the restricting plate 53.

Figure 12:
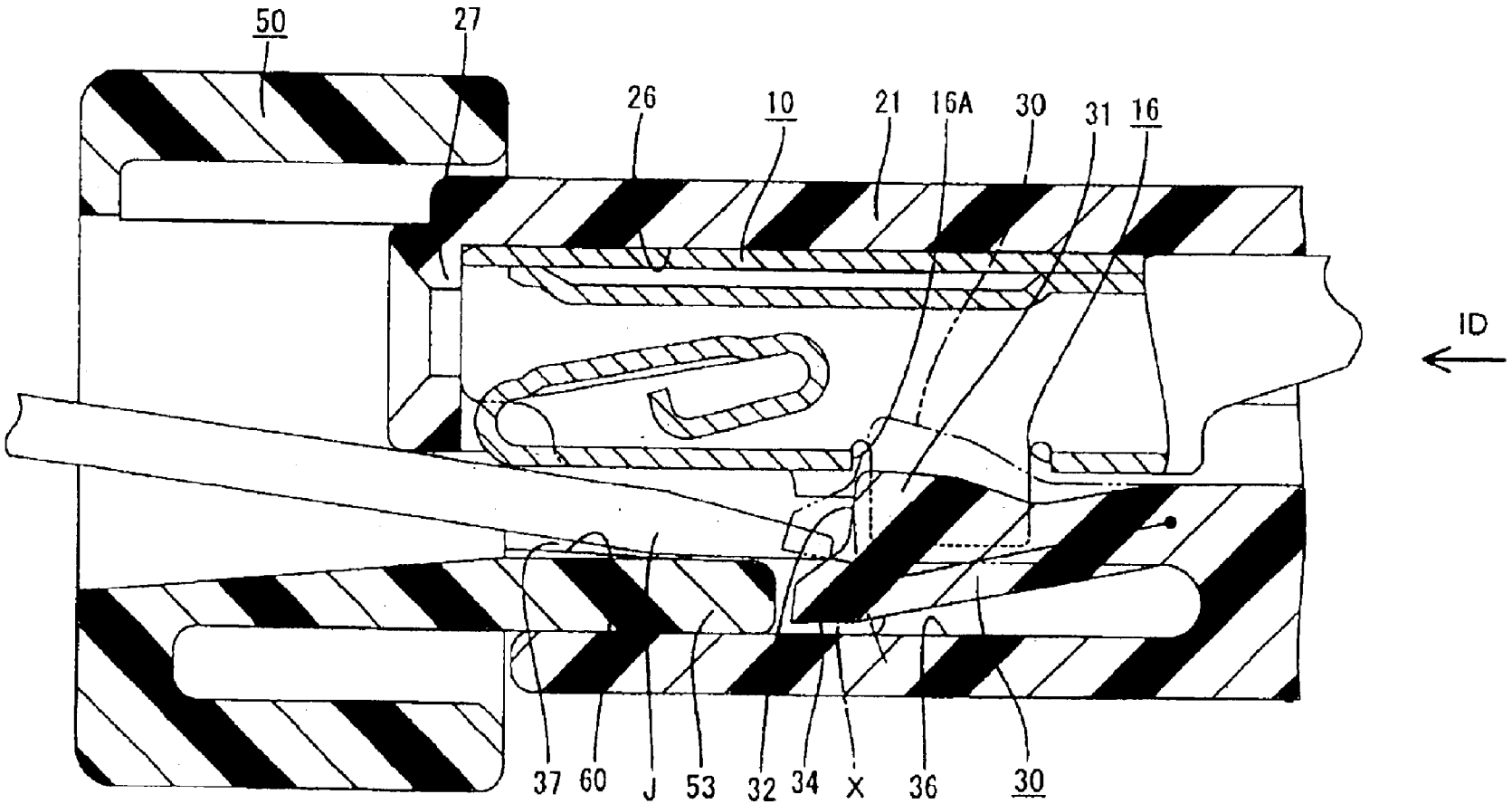
FIG. 12 is a longitudinal section showing a state where a locked state of the locking portion is canceled.
Figure 13:
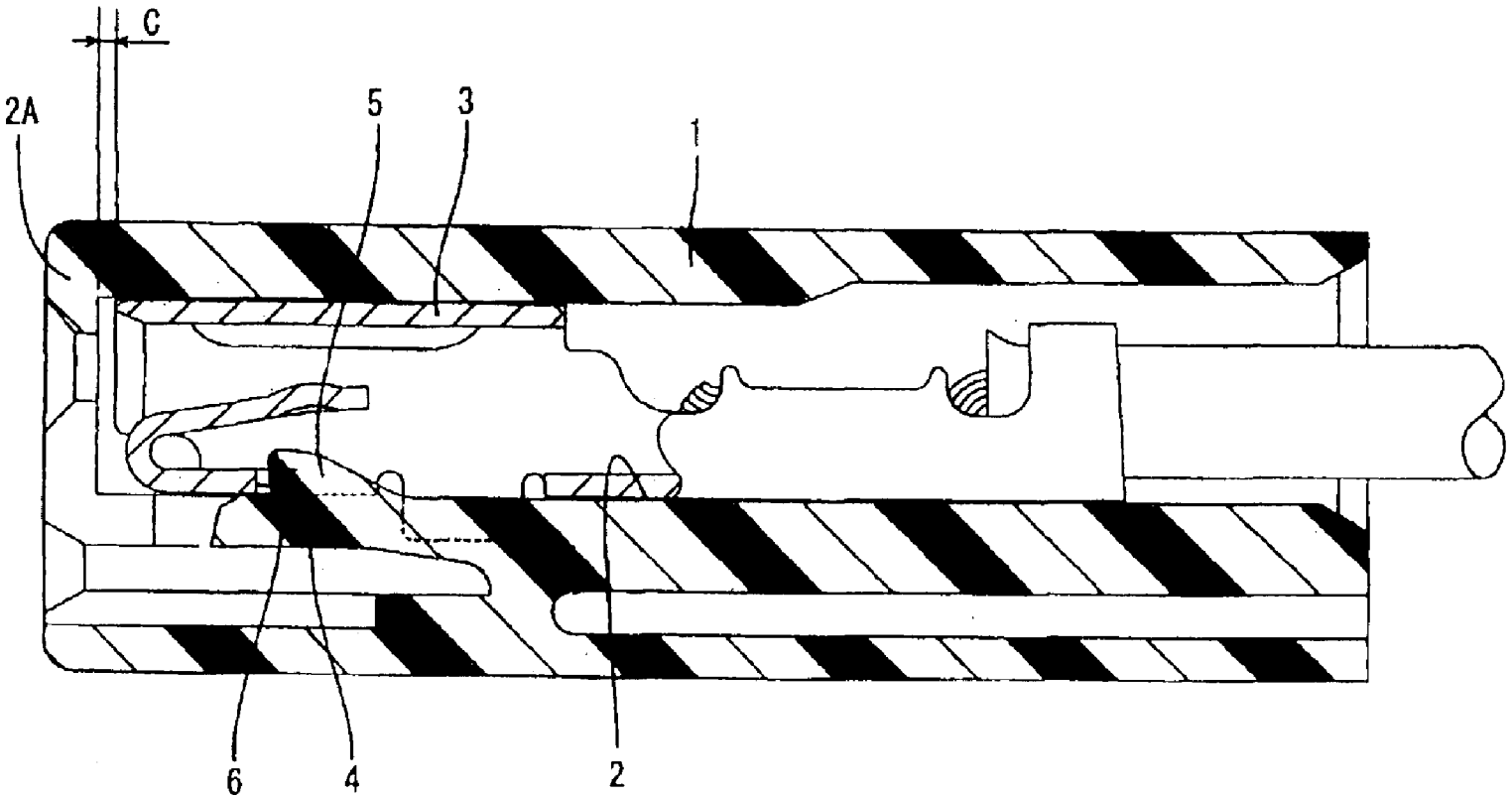
FIG. 13 PRIOR ART
FIG. 13 is a longitudinal section of a prior art connector.

An angle $\alpha$ of inclination of the locking surface 32 of the lock 30 is set so that a trace of displacement X of the top of the locking surface 32 is more backward than the front edge 16A of the locking hole 16 so as not to interfere with the front edge 16A when the lock 30 is displaced in the deformation direction DD toward the deformation space 36 while the female terminal 10 is in contact with the front wall 27 of the cavity 26 as shown in FIG. 12. A more moderate angle of inclination is more certain to avoid interference, but has a smaller a locking force of the lock 30. Therefore, it is desirable to set a steepest angle $\alpha$ of inclination within such a range as to avoid the interference.

Figure 8:
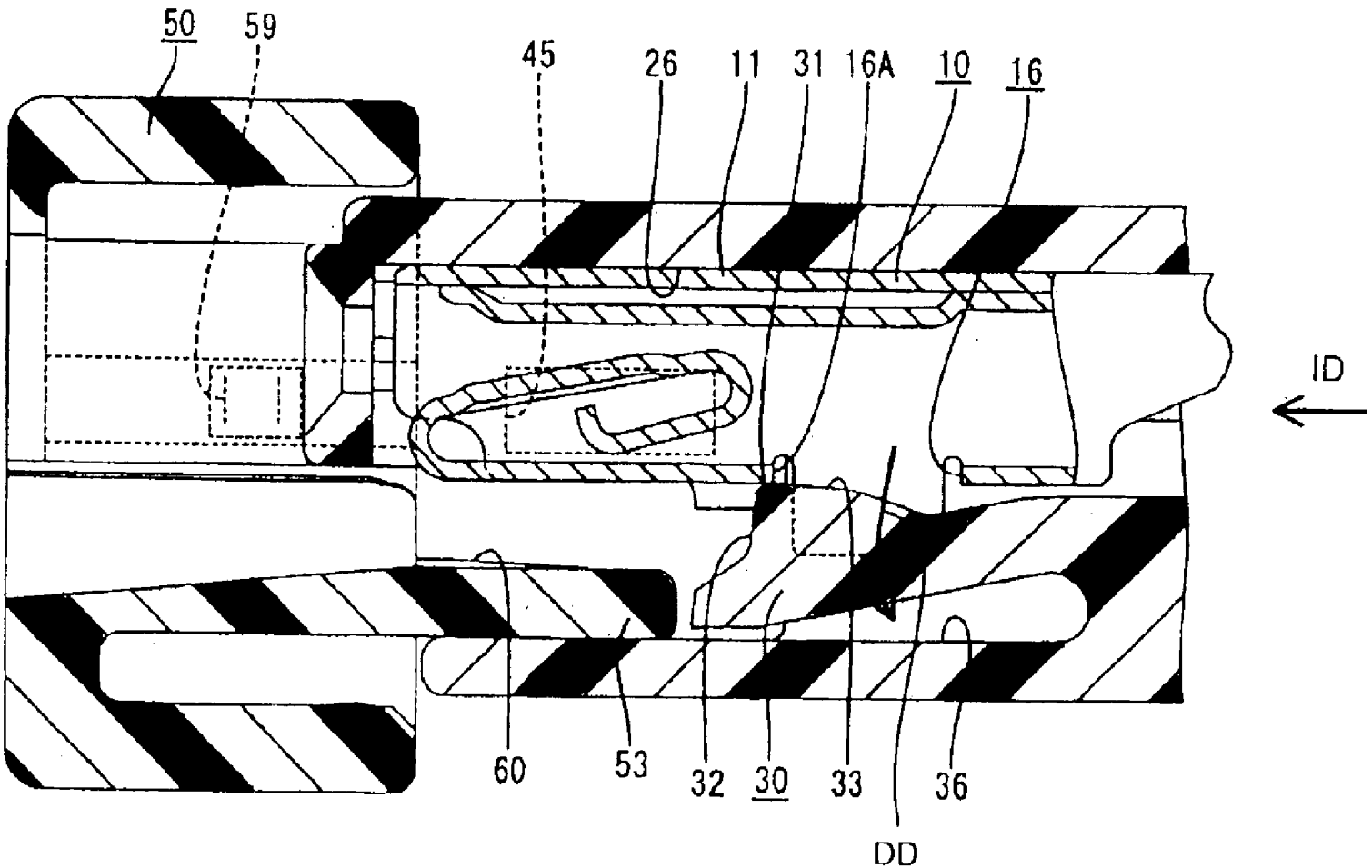
FIG. 8 is a longitudinal section showing an intermediate stage of the insertion of a female terminal.

The locking surface 32 projects more forward at the base than at the top, as shown in FIG. 8, before the lock 30 returns to enable the locking surface 32 to push the front edge 16A of the locking hole 16 forward when the lock 30 returns to its natural.

The female connector is assembled by first mounting the retainer 50 at the partial locking position with respect to the female housing 20 as shown in FIG. 7. The female terminals 10 then are inserted into the cavities 26 from behind and along the inserting direction ID. Each female terminal 10 moves onto the guiding surface 33 of the respective lock 30 and resiliently displaces the lock 30 in the deformation direction DD toward the deformation space 36 as shown in FIG. 8. Sufficient pushing of the female terminal 10 aligns the locking hole 16 with the locking projection 31. Thus, the lock 30 returns towards its original posture and locking projection 31 fits into the locking hole 16 for partly locking the female terminal 10.

The locking surface 32 of the locking projection 31 of the lock 30 is formed to be at an obtuse angle to the upper surface of the lock 30 before the locking projection 31 and to form an obtuse angle $\alpha$ to the inserting direction ID (see FIG. 1). Thus, the locking surface 32 can move the female terminal 10 forward in the inserting direction ID while pushing the front edge 16A of the locking hole 16 as the lock 30 returns as shown in FIG. 9. A clearance C between the front wall 27 of the cavity 26 and the front surface of the female terminal 10 is small and may be absent depending on the case.

The retainer 50 then is pushed from the partial locking position to the full locking position. Accordingly, the restricting plate 53 of the retainer 50 enters the deformation spaces 36, and the push-up protrusions 60 on the upper surface of the restricting plate 53 slip under the lower surfaces of the locks 30 to gradually push the locks 30 up towards the cavities 26. As a result, as shown in solid line in FIG. 11, the bottom ends of the locking surfaces 32 push the front edges 16A of the locking holes 16, and the female terminals 10 are moved further forward in the insertion direction ID and are pressed against the front walls 27 by cam action. Of course, a double locking function is displayed since the restricting plate 53 enters the deformation spaces 36 to prevent the downward resilient displacement of the locks 30.

The male terminals 65 are mounted similarly in the mating male connector and are moved forward in the cavities of the male housing.

Figure 11:
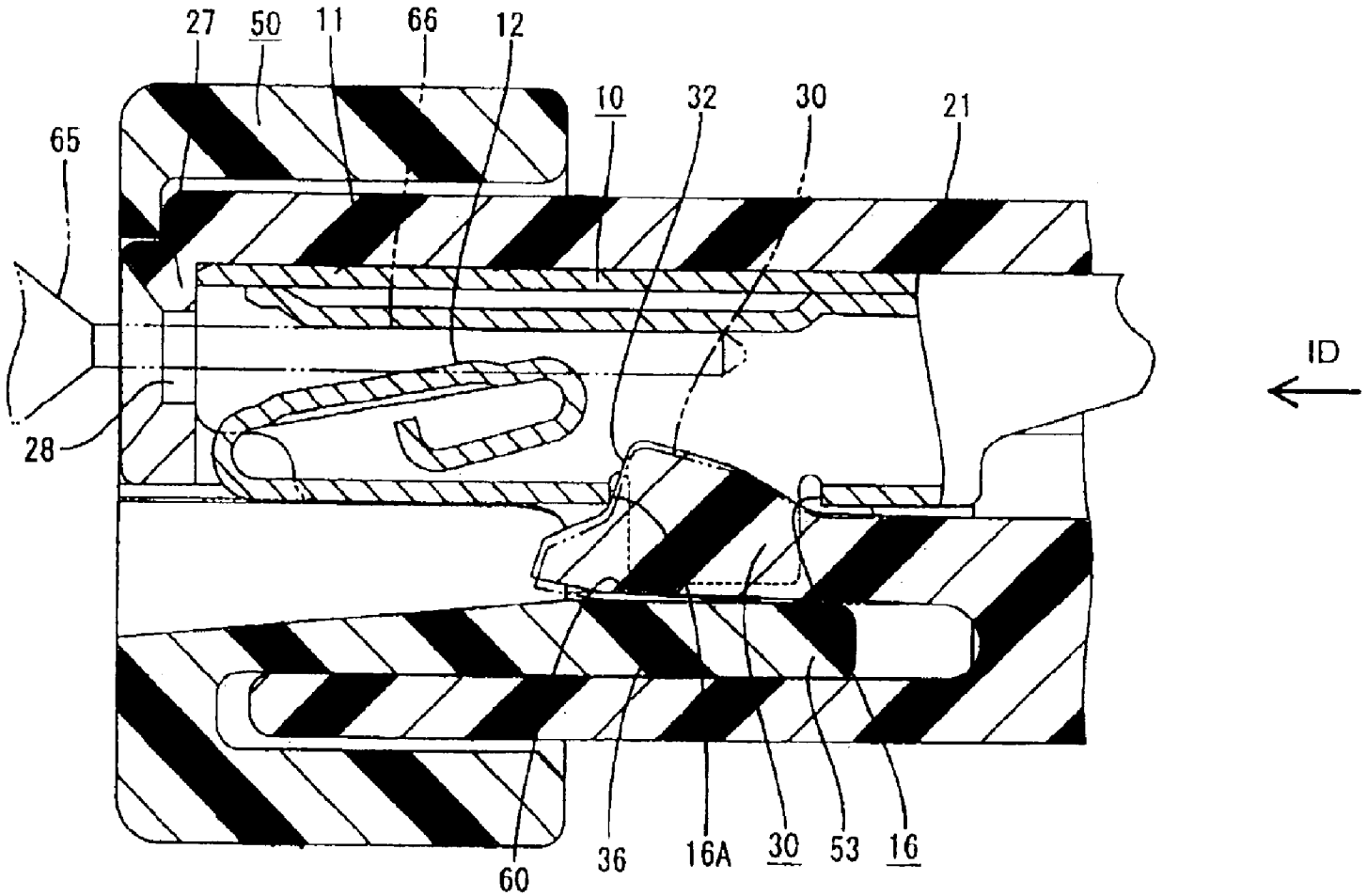
FIG. 11 is a longitudinal section showing a state where the female terminal is moved forward to eliminate a clearance.

As the female and male connectors are connected, the tabs 66 of the male terminals 65 are inserted into the respective connecting portions 11 of the female terminals 10 through the respective terminal insertion openings 28 and contact the resilient contact pieces 12, as shown in chain line in FIG. 11.

The connectors may be subjected to vibration. However, the female terminals 10 are pressed against the front walls 27 of the cavities 26 by the locks 30 and there is substantially no room for loose movement. Thus, no sliding movement is made at the contacts of the female terminals 10 with the tabs 66 of the mating male terminals 65 and there is no likelihood of abrasion.

The female terminal 10 is detached from the female housing 20 as follows for maintenance or other reason by returning the retainer 50 to the partial locking position from the state of FIG. 11. In this way, the locks 30 are freed from push-up forces from the push-up protrusions 60. Therefore, the locks 30 return to their natural states as shown in chain line in FIG. 12.

The jig J then is inserted into the jig insertion opening 37 and the disengagement operable portion 34 is pushed down in the deformation direction DD by the leading end of the jig J. Thus, the lock 30 is displaced resiliently in the deformation direction DD toward the deformation space 36 while the locking surface 32 passes behind or beyond the front edge 16A of the locking hole 16 without interference. As a result, the locking projection 31 comes out of the locking hole 16 to free the female terminal 10 from the locked state. The female terminal 10 then can be pulled out of the cavity 26 e.g. by pulling backward on the wire 15.

As described above, the locks 30 are displaced towards the cavities 26 when the retainer 50 is pushed to the full locking position and the female terminals 10 are moved further forward by the cam action of the forwardly tapered locking surfaces 32 and the front edges 16A of the locking hole 16 for substantially eliminating the clearances between the front walls 27 of the cavities 26 and the female terminals 10. Thus, even if the female connector is subjected to vibration, there is substantially no room for the female terminals 10 to make loose forward and backward movements in the cavities 26. Hence, there is neither sliding movement nor abrasion at the contact portions with the tabs 66 of the mating male terminals 65. As a result, the reliability of electrical connections between the female and male terminals 10, 65 can be improved.

The push-up protrusions 60 for pushing up the locks 30 are on the upper surface of the existing restricting plate 53 of the retainer 50 and can be formed easily without necessitating a large design change.

The retainer 50 can be held at the partial locking position. Thus, the female housing 20 and the retainer 50 can be handled while being assembled, thereby improving assembling operability.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Even if the push-up protrusions for pushing up the locking portions are not provided, the locking surfaces of the locking portions are the forward taper surfaces and have a particularly moderate angle of inclination, they can effectively push the front edges of the locking holes to move the female terminals forward as the locking portions return to their natural states. Such an embodiment is also embraced by the technical scope of the present invention.

Although briefly described in the description of the foregoing embodiment, the present invention is also applicable to male connectors accommodating one or more male terminals.

The present invention is also applicable to nonwatertight connectors.

What is claimed is:

1. A connector having a housing with opposite front and rear ends and at least one cavity extending between the front and rear ends and configured for receiving at least one terminal fitting, a resiliently displaceable lock provided on an inner wall of the cavity, the lock being configured for being resilient displaced by the terminal fitting during insertion of the terminal fitting into the cavity along an inserting direction, the lock resiliently returning when the terminal fitting is inserted a specified distance into the cavity so that a locking surface of the lock engages an engaging portion of the terminal fitting for locking the terminal fitting so as not to come out, the locking surface of the lock being slanted to form an obtuse angle with respect to the inserting direction, the obtuse angle being oriented so that portions of the locking surface projecting farther into the cavity are farther from the front end of the cavity when the lock is not deformed, a retainer mounted to the housing and configured for entering a deformation space for the lock to prevent the resilient displacement of the lock, whereby the obtuse angle of the locking surface enables the lock to urge the terminal fitting towards the front end of the cavity.

2. The connector of claim 1, wherein the retainer includes at least one pushing portion for engaging the lock to displace the lock towards the terminal fitting upon entering the deformation space.

3. The connector of claim 2, further comprising means for holding the retainer at a first position where the retainer is retracted from the deformation space to permit the resilient displacement of the locking and at a second position where the retainer is located in the deformation space.

4. The connector of claim 1, wherein the lock comprises a disengagement operable portion for engaging a disengagement jig inserted into the housing.

5. The connector of claim 4, wherein the disengagement operable portion is inclined with respect to the inserting direction and has a greater angle of inclination than the angle of the locking surface.

6. The connector of claim 1, wherein, the locking surface defines an angle of inclination with respect to the inserting direction of between approximately 100° and approximately 150°.

7. The connector of claim 6, wherein the locking surface defines an angle of inclination with respect to the inserting direction of between approximately 105° and approximately 140°.

8. The connector of claim 6, wherein the locking surface defines an angle of inclination with respect to the inserting direction of between approximately 110° and approximately 135°.

* * * * *